United States Patent [19]

Selonke et al.

[11] 4,223,845

[45] Sep. 23, 1980

[54] TOBACCO SHREDDING APPARATUS

[75] Inventors: Fritz Selonke, Hamburg; Werner Komossa, Börnsen; Uwe Elsner, Dassendorf; Gerhard Schlie, Hamburg, all of Fed. Rep. of Germany

[73] Assignee: Hauni-Werke Körber & Co., KG, Hamburg, Fed. Rep. of Germany

[21] Appl. No.: 919,788

[22] Filed: Jun. 28, 1978

[30] Foreign Application Priority Data

Jul. 6, 1977 [DE] Fed. Rep. of Germany ..... 2730442

[51] Int. Cl.[3] ..... B02C 18/22; B65G 43/08

[52] U.S. Cl. ..... 241/34; 241/36; 241/280; 198/524

[58] Field of Search ..... 241/34, 277, 36, 280, 241/281; 425/147; 198/524

[56] References Cited

U.S. PATENT DOCUMENTS

| | | | |
|---|---|---|---|
| 2,568,332 | 9/1951 | Genovese | 425/147 |
| 3,468,488 | 9/1969 | Karrer et al. | 241/34 |
| 3,480,212 | 11/1969 | Liljegren et al. | 241/34 |
| 3,773,268 | 11/1973 | Bond | 241/34 X |
| 4,037,712 | 7/1977 | Wochnowski | 241/34 X |
| 4,108,584 | 8/1978 | Radzius et al. | 425/147 X |

*Primary Examiner*—Mark Rosenbaum

*Attorney, Agent, or Firm*—Peter K. Kontler

[57] ABSTRACT

A tobacco shredding apparatus wherein a relatively small upright duct receives tobacco from a large magazine. A system of tobacco compacting chains draws tobacco from the lower part of the duct and feeds the resulting cake into the path of orbiting shredding knives. The chains and the knives are driven by a first variable-speed motor. A conveyor which is driven by a second variable-speed motor transfers tobacco from the magazine into the duct. The volume of tobacco in the duct is monitored by a first set of photocells whose signals are used to regulate the speed of the second motor so as to maintain the volume of tobacco in the duct within a first range. The volume of tobacco in the magazine is monitored by a second set of photocells whose signals are utilized to regulate the speed of the first motor so as to maintain the volume of tobacco in the magazine within a second range. The capacity of the magazine is between five and ten times the capacity of the duct.

10 Claims, 1 Drawing Figure

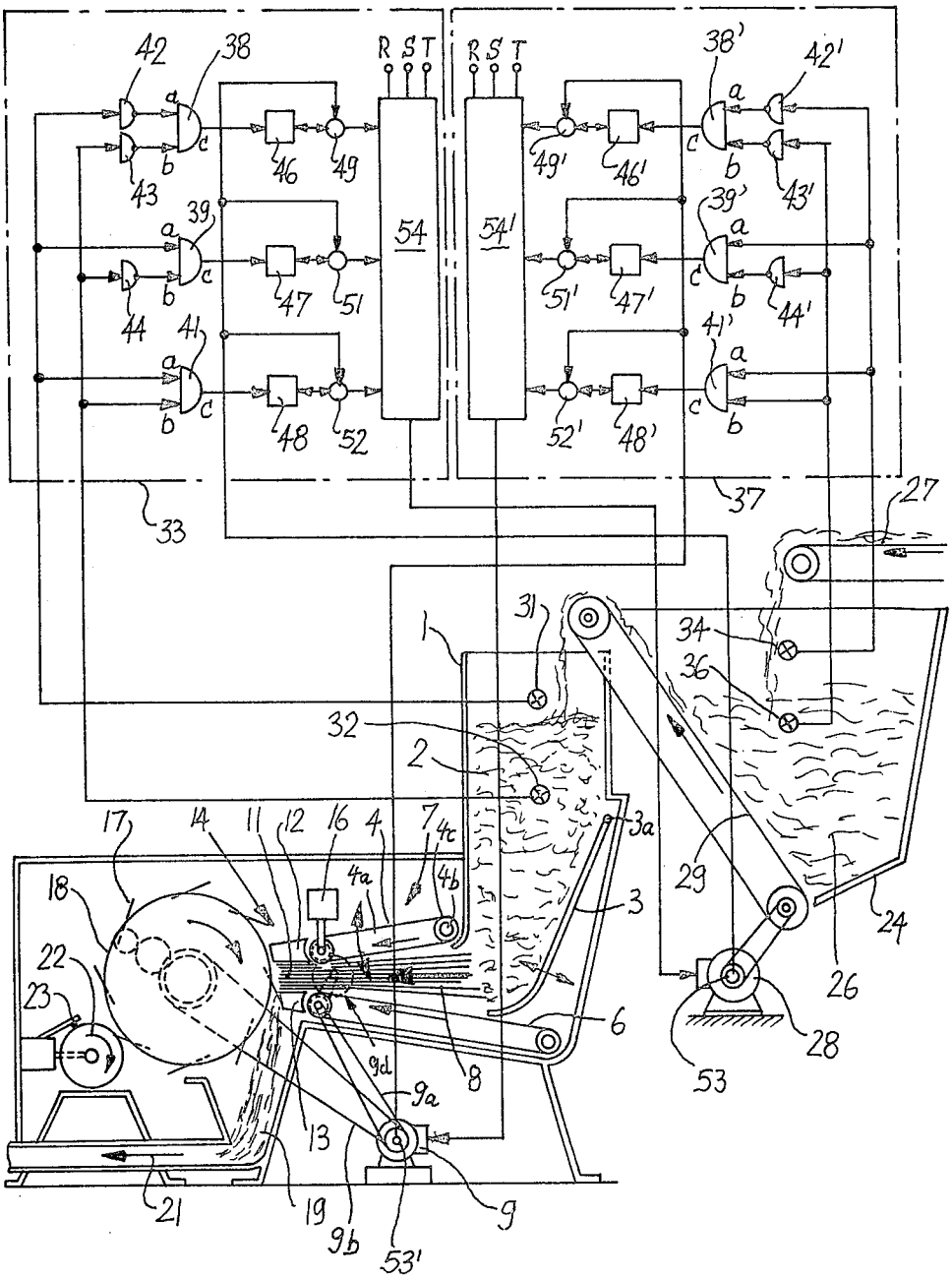
R S T
R S T
54
54'
33
37
27
24
26
28
53
53'
29
31
32
34
36
1
2
3
3a
4
4a
4b
4c
6
7
8
9
9a
9b
9d
11
12
13
14
16
17
18
19
21
22
23
38
38'
39
39'
41
41'
42
42'
43
43'
44
44'
46
46'
47
47'
48
48'
49
49'
51
51'
52
52'

TOBACCO SHREDDING APPARATUS

CROSS-REFERENCE TO RELATED CASES

The shredding apparatus of the present invention constitutes an improvement over and a further development of apparatus which are disclosed in commonly owned U.S. Pat. No. 4,037,712 graned to Wochnowski on July 26, 1977, and in commonly owned copending application Ser. No. 787,556 filed Apr. 14, 1977 by Wochnowski, now U.S. Pat. No. 4,172,515.

BACKGROUND OF THE INVENTION

The present invention relates to apparatus for comminuting tobacco, and more particularly to tobacco shredding apparatus. Still more particularly, the invention relates to improvements in tobacco shredding apparatus of the type disclosed in commonly owned U.S. Pat. No. 4,037,712 to Wochnowski.

The patent to Wochnowski discloses a shredding apparatus wherein an upright duct receives tobacco at a constant or substantially constant rate and admits tobacco into the space between two convergent chains which convert the tobacco particles into a cake and feed the leading end of the cake into the path of orbiting knives. The speed of the motor for the chains and for the knives is varied in dependency on changes of the volume of tobacco in the duct. Such apparatus are quite satisfactory. However, they cannot be incorporated into or combined with the machines of certain existing tobacco processing production lines. This is due to the fact that the existing production lines employ a wide variety of tobacco feeding devices, and the mode of operation of such feeding devices is based on different principles. Furthermore, the output of recent types of tobacco shredding apparatus is a multiple of the output of apparatus which, only a few years ago, were standard components of tobacco processing production lines. Therefore, the time allotted for the making of a satisfactory cake which is thereupon fed into the range of comminuting instrumentalities is extremely short. This, in turn, renders it necessary to insure uninterrupted satisfactory feed of tobacco into the space between the compacting chains. Finally, and since the shredding apparatus constitutes but one component of a long line of cooperating machines, and since the output of certain machines of the production line often fluctuates within a wide range, the shredding apparatus must be sufficiently flexible to immediately react to changes in delivery of tobacco thereto and/or to changes in the requirements of machine or machines which receive shredded tobacco therefrom.

A drawback of all presently known shredding apparatus is that the conditions under which the apparatus operate at an optimum rate cannot be altered to a substantial degree without affecting the quality of the product. Otherwise stated, the quality of the product is overly dependent on the condition, mode of operation and/or other parameters of the machine or machines which precede the shredding apparatus in existing production lines. Thus, even the operation of the aforementioned patented apparatus of Wochnowski is or can be strongly affected by fluctuations in the rate of delivery of tobacco to its duct. Furthermore, many presently known shredding apparatus exhibit the drawback that the existing controls which are employed to counteract the effect of fluctuations of the rate of tobacco feed often aggravate the situation, especially when the fluctuations of the rate of delivery are attributable to unpredictable parameters, such as changes in the size, moisture content and/or temperature of tobacco.

OBJECTS AND SUMMARY OF THE INVENTION

An object of the invention is to provide a novel and improved tobacco shredding apparatus whose operation is less dependent on fluctuations of tobacco feed thereto than the operation of heretofore known apparatus.

Another object of the invention is to provide an apparatus which can deliver a product of predictable quality irrespective of pronounced fluctuations (including interruptions) of admission of tobacco leaf laminae to its tobacco-receiving part or parts.

A further object of the invention is to provide a tobacco shredding apparatus which can be readily installed in all or nearly all existing production lines as a superior substitute for conventional shredding apparatus.

An additional object of the invention is to provide the apparatus with novel and improved means for storing and transferring tobacco.

Another object of the invention is to provide a shredding apparatus which can deliver shredded tobacco at a constant or nearly constant rate in spite of pronounced fluctuations of delivery of tobacco thereto.

The invention is embodied in a tobacco shredding apparatus which comprises a first tobacco-containing magazine, (e.g., an upright duct), a second tobacco-containing magazine having a capacity greater than (e.g., 5–10 times) the capacity of the first magazine, a system of tobacco transporting and compacting chains or analogous means for withdrawing tobacco from the first magazine, variable-speed means for comminuting the withdrawn tobacco (such comminuting means may include a set of orbiting knives and a variable-speed prime mover which drives the knives), variable-speed means for transferring tobacco from the second magazine into the first magazine (such means may include a carded conveyor and a variable-speed prime mover which drives the conveyor), first and second signal generating detector means for respectively monitoring the volume of tobacco in the first and second magazines (each monitoring means may include upper and lower level detectors, e.g., photocells), first control means for regulating the speed of the comminuting means in response to signals from the second detector means so as to maintain the volume of tobacco in the second magazine within a first predetermined range, and second control means for regulating the speed of the transferring means in response to signals from the first detector means so as to maintain the volume of tobacco in the first magazine within a second predetermined range.

The prime mover which drives the knives preferably also serves to drive the withdrawing means. Each control means may include a three-stage speed regulating unit. The apparatus preferably further comprises means for feeding tobacco to the second magazine at a substantially constant rate.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

The single FIGURE of the drawing is a partly elevational and partly diagrammatic view of a tobacco shredding apparatus which embodies the invention.

DESCRIPTION OF THE PREFERRED EMBODIMENTS

The shredding apparatus which is shown in the drawing comprises a substantially upright first magazine or duct 1 for storage of a supply 2 of tobacco (destalked tobacco leaf laminae). The lower portion of the duct 1 contains a customary rake 3 which is pivotably mounted at 3*a* and is movable back and forth (as indicated by the double-headed arrow) at predetermined intervals to advance tobacco from the lower portion of the duct into the space between the endless tobacco compacting chain conveyors 4 and 6 of a withdrawing unit 7 which advances tobacco in the direction indicated by arrow 8. The tobacco-engaging reaches of the chains 4 and 6 converge in the direction which is indicated by the arrow 8 so that they convert the leaf laminae into a dense tobacco cake 11 which passes through the opening between the upper and lower sections 12, 13 of a mouthpiece 14 on its way into the range of orbiting comminuting or shredding knives 17 mounted on a rotary drum-shaped carrier 18. The upper chain conveyor 4 is mounted on a frame 4*a* which is pivotable about the axis of the shaft 4*b* for the rear sprocket wheel 4*c*. The shaft for the front sprocket wheel of the chain 4 is urged downwardly by a dashpot 16 or analogous yieldable biasing means.

The front sprocket wheel for the lower chain 6 is driven by a toothed belt or chain 9*a* receiving motion from the output element of a variable-speed prime mover 9, e.g., a D.C. motor. The belt or chain 9*a* further drives the front pulley of the upper chain 4 by way of a gearing 9*d* which is indicated by broken lines. A second belt or chain drive 9*b* transmits torque from the output element of the motor 9 to the shaft of the carrier 18.

The orbiting knives 17 sever the leader of the cake 11, and the resulting shreds 19 descend toward the intake of a pneumatic conveyor 21 which transports the shreds to the next processing station, not shown.

The knives 17 are sharpened by a grinding wheel 22 which is driven to rotate in the direction indicated by arrow and whose peripheral surface is treated by a diamond 23 or another suitable dressing tool. The lower section 13 of the mouthpiece 14 constitutes a stationary counterknife which cooperates with successive knives 17 to convert the cake 11 into shreds 19.

The duct 1 receives tobacco from a second or main magazine 24 which is closely adjacent to the duct and can store a relatively large supply 26 of tobacco leaf laminae. For example, the quantity of tobacco in the magazine 24 may be 5–10 times the quantity of tobacco forming the supply 2 in the duct 1. The apparatus further comprises an endless belt conveyor 27 which feeds tobacco to the magazine 24, preferably at a constant or substantially constant rate. It will be readily appreciated that, under ideal circumstances, the conveyor 27 should invariably feed identical quantities of tobacco per unit of time.

The means for transferring tobacco from the magazine 24 into the duct 1 comprises an endless carded conveyor 29 whose right-hand reach (as viewed in the drawing) constitutes a moving wall of the magazine 24 and transports a continuous stream of laminae into the upper portion of the duct. The conveyor 29 is driven by a variable-speed prime mover 28 (e.g., an electric motor) whose RPM is monitored by a tachometer generator 53. The RPM of the motor 9 is monitored by a second tachometer generator 53'.

The signal generating detector means for monitoring the volume of tobacco which forms the supply 2 in the duct 1 comprises two level detectors here shown as photocells 31 and 32 which are disposed at different levels and transmit signals to an RPM regulating control unit 33 for the variable-speed motor 28. The signals from the photocells 31, 32 are utilized to insure that the speed of the tobacco transferring conveyor 29 changes when the volume of tobacco in the duct 1 rises to the level of the upper photocell 31, descends below the level of the photocell 31, descends below the level of the lower photocell 32, or rises above the level of the photocell 32.

The signal generating detector means for monitoring the volume of tobacco which forms the supply 26 in the second or main magazine 24 comprises two photocells 34, 36 which transmit signals to an RPM regulating control unit 37 for the variable-speed motor 9. The control unit 37 insures that the speed of the withdrawing unit 7 and carrier 18 changes in response to changes of the volume of the supply 26. The relationship is such that adjustments of the RPM of the motor 9 insure that the volume of the supply 26 is substantially constant, i.e., that such volume remains within a predetermined range.

The construction of the RPM regulating control unit 33 is identical to that of the control unit 37. Therefore, similar parts of the two control units are denoted by identical reference characters with each character denoting a part of the control unit 37 followed by a prime. The control unit 33 comprises three AND gates 38, 39, 41. The inputs a and b of the AND gate 38 are respectively connected with the photocells 31 and 32 via inverters 42 and 43. The input a of the AND gate 39 is connected directly to the photocell 31, and the input b of the AND gate 39 is connected with the photocell 32 via inverter 44. The inputs a and b of the AND gate 41 are connected directly with the photocells 31 and 32. The outputs c of the AND gates 38, 39 and 41 are respectively connected with discrete sources 46, 47 and 48 of reference signals (each such source may constitute an adjustable potentiometer). The reference signal at the output of the source 46 (such signal appears when the input of the source 46 receives a signal from the output c of the AND gate 38) is indicative of a relatively low RPM. The reference signal at the output of the source 47 is indicative of an average or median RPM, and the reference signal at the output of the source 48 is indicative of a relatively high RPM which, however, need not be much higher than the RPM denoted by the reference signal which is transmitted by the source 47 when the latter receives a signal from the output of the AND gate 39. The outputs of the sources 46, 47 and 48 respectively transmit signals to discrete signal comparing stages 49, 51 and 52 which further receive signals from the tachometer generator 53. The output of the stage 49 transmits a signal of varying intensity when the intensity or another characteristic of the reference signal at the output of the source 49 deviates from the same characteristic of the signal which is transmitted by the tachometer generator 53. Analogously, the stages 51 and 52 respectively transmit signals of varying intensity when the intensity of signal furnished by the tachometer generator 53 deviates from intensities of reference signals which are transmitted by the sources 47 and 48.

The means for adjusting the RPM of the motor 28 in response to a signal from the stage 49, 51 or 52 comprises a three-stage thyristor amplifier 54 of known design, e.g., an amplifier with D.C. output of the type known as "Minisemi" produced by the firm AEG, Federal Republic Germany.

The operation is as follows.

The carding of the transferring conveyor 29 draws tobacco from the supply 26 and delivers the tobacco into the duct 1. The supply 26 of tobacco is assumed to fill the main magazine 24 to a level somewhere between the levels of the photocells 34, 36, and the upper level of tobacco supply 2 in the duct 1 is assumed to be at a level between the photocells 31 and 32. The quantity of tobacco forming the supply 2 is then between 10 and 20 percent of the quantity of tobacco which forms the supply 26. Such situation prevails when the motor 9 is operated at an average speed. The motor 28 is operated at an average speed because the three-stage amplifier 54 receives a signal from the stage 51. As shown, the input a of the AND gate 39 receives a signal from the upper photocell 31 in the duct 1 because this photocell is not buried in the supply 2. The lower photocell 32 does not transmit a signal because the supply of tobacco in the duct interrupts the light beam between its light source and its signal generator. However, the input b of the AND gate 39 then receives a signal from the inverter 44 so that the output c of the gate 39 transmits a signal to the source 47 which supplies a reference signal to the stage 51. The stage 51 transmits the signal to the amplifier 54 and causes the latter to operate the motor 28 at an average or median speed. The output c of the AND gate 38 does not transmit a signal because its input a does not receive the signal which is transmitted by the photocell 31. The output c of the AND gate 41 is also incapable of transmitting a signal because its input b does not receive a signal from the lower photocell 32. As mentioned above, the average speed which is commensurate with intensity of the reference signal from the source 47 is not substantially less than the maximum RPM of the motor 28.

The volume of the supply 2 in the duct 1 is likely to change, from time to time, in spite of the fact that the carded transferring conveyor 29 is driven at a constant speed and delivers tobacco at a substantially constant rate. Fluctuations of the volume of supply 2 are likely to occur as a result of changes in certain characteristics of conveyed tobacco, such as temperature, moisture content, particle size and/or other parameters. Thus, it happens, from time to time, that the upper level of the supply 2 rises to the level of and deactivates the upper photocell 31 or that the level of the supply 2 descends below and thereby activates the photocell 32.

When the level of the supply 2 rises above the level of the photocell 31, this automatically deactivates the AND gate 39 due to the absence of an inverter between the photocell 31 and the input a of the gate 39, and the AND gate 41 remains inactive. However, the output c of the AND gate 38 transmits a signal to the source 46 because its inputs a and b respectively receive signals from the inverters 42 and 43. The stage 49 transmits the reference signal from 46 to the amplifier 54 which reduces the RPM of the motor 28. The deceleration of the motor 28 is terminated when the intensity of signal from the tachometer generator 53 matches the intensity of reference signal from the source 46. From there on, the speed of the motor 28 is substantially constant. The just described deceleration of the motor 28 entails a practically immedite reduction of the volume of the supply 2 but the upper level of the much larger supply 26 rises only insignificantly, i.e., such level still remains between the levels of the photocells 34 and 36.

The level of the supply 2 thereupon descends below the upper photocell 31 whereby the AND gate 39 begins to transmit signals to the source 47 and the AND gate 38 ceases to transmit signals to the source 46. The AND gate 41 remains inactive. The amplifier 54 increases the speed of the motor 28 to average speed. The adjustment is terminated when the intensity of signal from the tachometer generator 53 matches the intensity of reference signal which is transmitted by the source 47.

If the supply 2 of tobacco in the duct 1 decreases so that the upper level of such supply descends below the lower photocell 31, the AND gate 38 remains inactive, the AND-gate 39 is deactivated, and the output c of the AND gate 41 transmits a signal to the source 48 which transmits a reference signal via signal comparing stage 52 whereby the amplifier 54 accelerates the motor 28 and the conveyor 29. The acceleration is terminated when the intensity of signal from the tachometer generator 53 matches the intensity of reference signal which is transmitted by the source 48. Since the motor 28 is driven at a relatively high speed, the upper level of the supply 2 begins to rise and the speed of the motor 28 is reduced to average speed as soon as the lower photocell 31 is again buried in the supply 2.

If the upper level of the supply 26 in the main magazine 24 rises above the upper photocell 34 or descends below the lower photocell 36, the RPM regulating control unit 37 changes the speed of the motor 9. Such pronounced fluctuations of the volume of the supply 26 can take place in spite of the fact that the capacity of the magazine 24 greatly exceeds the capacity of the duct 1. For example, the volume of the supply 26 can be changed drastically as a result of lengthy stoppage of the feeding conveyor 27, as a result of pronounced deceleration of the conveyor 27, as a result of failure of the conveyor 27 to deliver the anticipated quantity of tobacco leaf laminae while being driven at normal speed, or as a result of delivery of tobacco into the magazine 24 at a rate which greatly exceeds the anticipated rate.

The operation of the RPM regulating control unit 37 in response to burying of the upper photocell 34 or in response to exposure of lower photocell 36 is analogous to the operation of the RPM regulating unit 33 under similar circumstances. Thus, when the level of the supply 26 rises above the photocell 34, the AND gate 38' causes the source 46' to transmit a reference signal to the three-stage amplifier 54' via signal comparing stage 49' whereby the amplifier 54' accelerates the motor 9. The rate of shredding is increased and the supply 2 decreases so that the control unit 33 accelerates the motor 28 which causes the conveyor 29 to increase the rate of transfer of tobacco from the main magazine 24. This results in a lowering of the upper level of the supply 26 and the speed of the motor 9 is reduced to average speed. The need to accelerate the motor 9 to maximum speed arises infrequently because the capacity of the main magazine 24 is sufficient to insure that minor fluctuations of the volume of the supply 26 do not entail any changes in the condition of the control unit 37.

When the upper level of the supply 26 descends below the lower photocell 36 in the magazine 24, the output c of the AND gate 41' transmits a signal to the source 48' which transmits an appropriate reference signal to the amplifier 54' via signal comparing stage 51' whereby the speed of the motor 9 is reduced below average speed. Thus, the rate of transfer of tobacco from the magazine 24 into the duct 1 is reduced and the upper level of the supply 26 begins to rise. The speed of the motor 9 is increased to average speed as soon as the rising supply 26 confines the lower photocell 36.

The improved shredding apparatus is susceptible of many modifications without departing from the spirit of the invention. For example, the means for monitoring the volume of tobacco in the duct 1 and/or in the main magazine 24 may comprise more than two photosensitive or other detectors. The apparatus is then equipped with somewhat more complex RPM regulating control units which can change the RPM of the motor 28 and/or 9 to any one of four or more different speeds. It has been found that the relatively simple detector means 31, 32 and 34, 36 and the relatively simple three-stage control means 33 and 37 suffice to insure reliable operation of the shredding apparatus in practically all presently known production lines. Furthermore, the magazine 24 can be provided with additional detectors one of which is disposed above the photocell 34 and, when buried in tobacco of the supply 26, arrests the motors 9 and 28. Another additional detector can be installed at a level below the photocell 36 to arrest the motors 9 and 28 when the supply of tobacco in the main magazine 24 is depleted to a predetermined minimum permissible value.

The improved shredding apparatus exhibits several important advantages. Thus, the apparatus can be manufactured and sold as an autonomous unit which can be installed in existing plants as a superior substitute for conventional shredding apparatus. All that is necessary is to provide a suitable feed (to perform the function of the conveyor 27) which supplies tobacco to the main magazine at a reasonably constant or at least somewhat predictable rate.

Another important advantage of the apparatus is that, in most instances, the speed of the motor 9 is constant because the volume of the supply 26 in the main magazine 24 is sufficiently large to insure that eventual fluctuations of the upper level of such supply are within the range which is selected by mounting of the photocells 34, 36 or analogous level detectors. On the other hand, the RPM regulating control unit 37 insures that the main magazine 24 is neither overfilled nor underfilled for extended intervals of time, even when the rate of delivery of tobacco thereto fluctuates within an extremely wide range.

An additional important advantage of the improved apparatus is that the quality of shredded tobacco 19 is constant or practically constant because the volume of tobacco supply 2 in the duct 1 cannot fluctuate beyond a predetermined range which can be selected by appropriate positioning of the photocells 31, 32 and also because the speed of the motor 9 is changed infrequently or not at all. The density of the cake 11 is affected by fluctuations of the volume of supply 2 in the duct 1; therefore, it is highly desirable to prevent excessive fluctuation of the upper level of the supply 2. This is achieved by the provision of the RPM regulating control unit 33 for the motor 28 which drives the tobacco transferring conveyor 29.

A further important advantage of the improved shredding apparatus is that it can be operated at or close to maximum capacity for extended periods of time. This will be readily appreciated since, under normal operating conditions, the speed of the motor 9 remains constant so that the average speed of the motor 9 need not be much less than the maximum speed. In other words, the output of the shredding apparatus is high not only when the speed of the motor 9 is increased, if necessary, to effect a reduction of the volume of the supply 26 but also when the amplifier 54' causes the motor 9 to operate at an average speed. As mentioned above, fluctuations of the volumes of the supplies 2 and 26 are infrequent and relatively small, and the intervals which are available to counteract such fluctuations are rather long. Therefore, it is not necessary to construct the control unit 37 in such a way that the maximum speed of the motor 9 is much higher than the normal operating or average speed.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

What is claimed is:

1. In a tobacco shredding apparatus, the combination of a first tobacco-containing magazine; a second tobacco-containing magazine having a capacity greater than the capacity of said first magazine; means for withdrawing tobacco from said first magazine; variable-speed means for comminuting the withdrawn tobacco; variable-speed means for transferring tobacco from said second magazine into said first magazine; first and second signal generating detector means for respectively monitoring the volume of tobacco in said first and second magazines; first control means for regulating the speed of said comminuting means in response to signals from said second detector means so as to maintain the volume of tobacco in said second magazine within a first range; and second control means for regulating the speed of said transferring means in response to signals from said first detector means so as to maintain the volume of tobacco in said first magazine within a second range.

2. The combination of claim 1, wherein said comminuting means and said transferring means respectively comprise first and second variable-speed prime movers and said first and second control means respectively comprise means for changing the speed of said first and second prime movers in response to signals from the associated detector means.

3. The combination of claim 1, wherein the capacity of said first magazine is between 10 and 20 percent of the capacity of said second magazine.

4. The combination of claim 1, wherein each of said detector means includes an upper and a lower level detector and each of said control means comprises a three-stage speed regulating unit.

5. The combination of claim 1, wherein said comminuting means comprises a variable-speed prime mover and further comprising means for transmitting motion from said prime mover to said withdrawing means, said first control means including means for regulating the speed of said prime mover in response to signals from said second detector means.

6. The combination of claim 5, further comprising means for feeding tobacco to said second magazine at a substantially constant rate.

7. The combination of claim 5, wherein said withdrawing means comprises means for compacting tobacco.

8. The combination of claim 1, wherein said first magazine comprises a substantially upright duct.

9. The combination of claim 1, wherein each of said detector means comprises a plurality of photocells.

10. The combination of claim 1, wherein said magazines are closely adjacent to each other and said transferring means forms part of one of said magazines.

* * * * * *